US007917074B2

(12) United States Patent
Takada

(10) Patent No.: US 7,917,074 B2
(45) Date of Patent: Mar. 29, 2011

(54) FIXING DEVICE AND IMAGE FORMING APPARATUS

(75) Inventor: Mikihiko Takada, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 348 days.

(21) Appl. No.: 12/126,000

(22) Filed: May 23, 2008

(65) Prior Publication Data

US 2009/0074485 A1 Mar. 19, 2009

(30) Foreign Application Priority Data

Sep. 14, 2007 (JP) ..... 2007-239017

(51) Int. Cl.
*G03G 15/20* (2006.01)

(52) U.S. Cl. ..... 399/329

(58) Field of Classification Search ..... 399/328, 399/329, 330, 331; 219/216
See application file for complete search history.

(56) References Cited

U.S. PATENT DOCUMENTS

| | | | | |
|---|---|---|---|---|
| 6,895,208 | B2 * | 5/2005 | Nakatogawa et al. | 399/329 |
| 7,024,145 | B2 * | 4/2006 | Aruga et al. | 399/329 |
| 7,260,353 | B2 * | 8/2007 | Takemura | 399/329 |
| 7,379,697 | B2 * | 5/2008 | Ito et al. | 399/329 |
| 7,711,305 | B2 * | 5/2010 | Matsumoto | 399/329 |
| 2009/0074486 | A1 * | 3/2009 | Takada | 399/329 |

FOREIGN PATENT DOCUMENTS

| | | | |
|---|---|---|---|
| JP | 11-2979 | | 1/1999 |
| JP | 2002-148970 | | 5/2002 |
| JP | 2003107936 | A * | 4/2003 |
| JP | 2003140492 | A * | 5/2003 |
| JP | 2004109878 | A * | 4/2004 |
| JP | 2005077872 | A * | 3/2005 |
| JP | 2005250282 | A * | 9/2005 |
| JP | 2005331576 | A * | 12/2005 |
| JP | 2006091499 | A * | 4/2006 |
| JP | 2007010842 | A * | 1/2007 |
| JP | 2007079183 | A * | 3/2007 |

* cited by examiner

*Primary Examiner* — Robert Beatty
(74) *Attorney, Agent, or Firm* — Cantor Colburn LLP

(57) ABSTRACT

A fixing device including a pressure member that presses an endless fixing belt toward a fixing nip portion from the inner circumferential surface side; a sliding sheet that covers the pressure member; and a regulating member arranged on an end part of the sliding sheet for regulating the slack of the sliding sheet.

11 Claims, 10 Drawing Sheets

FIXING DEVICE AND IMAGE FORMING APPARATUS

This application is based on Japanese Patent Application No. 2007-239017 filed on Sep. 14, 2007 in Japanese Patent Office, the entire content of which is hereby incorporated by reference.

BACKGROUND OF THE INVENTION

The present invention relates to a fixing device for heating and pressing a sheet with a toner image, and fixing the toner image onto the sheet, and an image forming apparatus provided with the aforementioned fixing device.

In the conventional art, as the fixing device used in the image forming apparatus using electrophotographic process in a photocopier, printer, fax machine, and multifunction machine provided with the functions thereof, the fixing device of heating roller system (also referred to as a heat-fixing roller system) has been employed over an extensive range from low-speed to high-speed machines as well as from monochromatic to color machines. In the fixing device of heating roller system, heat and pressure are applied to the transfer material with an unfixed toner image formed thereon, by a fixing nip portion made up of a heating roller kept at a predetermined temperature, and a pressure roller having an elastic layer and being pressed against the heating roller, while the transfer material is sandwiched and conveyed thereby.

Widening the fixing nip portion is required to heat toner efficiently on the sheet surface by the demand for colorization and speedup in late years. In this case, viewing the constitution of the aforementioned fixing device of a heat roller system, a means for enlarging the diameters of the two rollers or increasing the pressurizing force between the rollers, thereby increasing the crush (distortion) amount of the rollers would be considered to widen the nip portion. However, when such a method is employed, there may arise a problem with respect to the enlargement of the size of the fixing device and the reduction in durability of the fixing device and the degree of freedom of design conditions is low.

As a method for solving this problem, a fixing device of a belt nip system having an rotating endless fixing belt driven by a roller and a pressing member fixed on the inner circumferential surface side of the fixing belt and pressing the fixing belt toward the heating roller by the pressing member has been adopted in recent years. In the fixing device of a belt nip system, from the viewpoint of its constitution, the width of fixing nip portion can be set to be wider than in the heating roller system.

The fixing device of nip belt system is designed in such a way that the fixing belt is pressed against the heating roller by means of a pressure member of fixed sliding type. Accordingly, if there is a great friction between the inner surface of the fixing belt and the pressure member, traveling of the fixing belt is blocked, and this will cause image misregistration or sheet wrinkles.

In an attempt to solve such problems, Unexamined Japanese Patent Application Publication No. 2002-148970 discloses a fixing device to prevent image misregistration from occurring, wherein the aforementioned fixing device is provided with a sheet-shaped member to cover the pressure member for the purpose of reducing the drag of friction with the inner circumferential surface of the fixing belt, and large irregularities are formed on the surface of the sheet-shaped member.

In the fixing nip portion of the fixing device of the belt nip system, the pressure member and a pressure roller located on the downstream side thereof are pressed against the heating roller, whereby a fixing nip portion of relatively greater width is formed. Further, the pressure roller transforms the elastic layer of the heating roller, and thereby facilitating separation of sheet from the heating roller. In the fixing nip portion of such a fixing device, when there is a wider low-pressure area between the pressure roller and pressure member wherein the pressure is low, the failure is more frequently caused by image irregularities. The failure in the sense in which it is used here refers to the image defect such as irregularities of the toner image caused by expansion of air and production of vapor in the toner layer as a result of heating in a low-pressure area.

To solve the aforementioned problems, the Unexamined Japanese Patent Application Publication No. H11-2979 discloses a fixing device including a pressure member equipped with a projection which protrudes toward the pressure roller side, and is arranged so as to press against the endless belt surface leading to the pressure roll. This is intended to improve the pressure distribution.

To prevent an image defect from occurring due to the low-pressure area of the fixing nip portion, it is effective to allow the pressure member to come as close as possible to the pressure roller in order to reduce the width of the low-pressure area. However, when the pressure member is brought close to the pressure roller, a sliding sheet covering the pressure member is pulled toward the pressure roller by the sliding with the fixing belt, and is pulled inside the pressure roller brought close thereto, if the sliding sheet is slacked. FIG. 12 shows that the sliding sheet is pulled inside the pressure roller. As shown in FIG. 12, when the sliding sheet 860 is slacked, the sliding sheet will be pulled inside the contact surface "ci" between the pressure roller 84 coming close on the downstream side of the sheet and fixing belt 82. When the sliding sheet has been pulled inside, wear will progress, with the result that the sliding sheet will be broken.

To prevent this, the pressure member must be covered with the sliding sheet in such a way that the sliding sheet is not slacked. However, if the sliding sheet is too tight, transformation of the pressure member will be blocked when the pressure member is pressed, and a desired pressure cannot be applied, with the result that pressure failure will occur. To solve this problem, a technique was proposed wherein the degree of slack was set in such a level that the sheet would not be pulled inside the pressure roller, and transformation of the pressure member would not be blocked.

However, the aforementioned method was accompanied with a new problem wherein, on the end part outside the pressure member, the sliding sheet was pulled inside the pressure roller and was broken. The cause of this problem can be explained as follows: On the end part, there is no contact with the pressure member, and therefore, there is much slack of sliding sheet and the pressure roller tends to pull it inside. Further, frictional drag between the pressure member and sliding sheet serves to reduce the force of pulling inside, but it does not work on the end part since there is no pressure member. Thus, the sheet tends to be pulled inside the pressure roller.

The present invention was created in order to solve these problems in the conventional art. An object of the present invention is to provide a fixing device using a fixing belt to ensure that the sliding sheet covering the pressure member that is pressed against the inner circumferential surface of the fixing belt will not be pulled inside the nearby roller to be broken.

SUMMARY

The aforementioned object of the present invention can be achieved by the following embodiments of the invention.

(1) A fixing device including a heating section and a pressure section that press the heating section to forms a fixing nip portion, wherein at least one of the aforementioned heating section and pressure section comprising:

an endless fixing belt being rotated;

a plurality of rollers which stretch the fixing belt therebetween;

a pressure member that presses the fixing belt toward the fixing nip portion from a side of an inner circumferential surface of the fixing belt, being provided in a vicinity of a roller being arranged on a downstream side of the fixing nip portion in a rotating direction of the fixing belt;

a sliding sheet that covers the pressure member; and a regulating member arranged on the end part of the sliding sheet for regulating the slack of the sliding sheet.

(2) A fixing device including a heating section and a pressure section that press the heating section to forms a fixing nip portion, wherein at least one of the aforementioned heating section and pressure section comprising:

an endless fixing belt being rotated;

a plurality of rollers which stretch the fixing belt therebetween;

a pressure member that presses the fixing belt toward the fixing nip portion from a side of an inner circumferential surface of the fixing belt, being provided in a vicinity of a roller being arranged on a downstream side of the fixing nip portion in a rotating direction of the fixing belt; and a sliding sheet that covers the pressure member wherein the sliding sheet end part outside the pressure member is arranged to be separated from the inner circumferential surface of the fixing belt.

(3) A fixing device including a heating section and a pressure section that press the heating section to forms a fixing nip portion, wherein at least one of the aforementioned heating section and pressure section comprising:

an endless fixing belt being rotated;

a plurality of rollers which stretch the fixing belt therebetween;

a pressure member that presses the fixing belt toward the fixing nip portion from a side of an inner circumferential surface of the fixing belt, being provided in a vicinity of a roller being arranged on a downstream side of the fixing nip portion in a rotating direction of the fixing belt; and a sliding sheet that covers the pressure member wherein only the end face of the sliding sheet outside the covering area for the pressure member is coated with fluorine resin.

(4) An image forming apparatus including:

an image forming section for forming a toner image on a sheet; and the fixing device described in any one of the Items (1) through (3) wherein the toner image formed by the aforementioned image forming section is heated, pressed and fixed onto the sheet in the fixing nip portion.

DETAILED DESCRIPTION OF THE PREFERRED EMBODIMENT

The present invention will be described on the basis of embodiments, however the present invention is not limited to the concerned embodiments.

Figure 1:
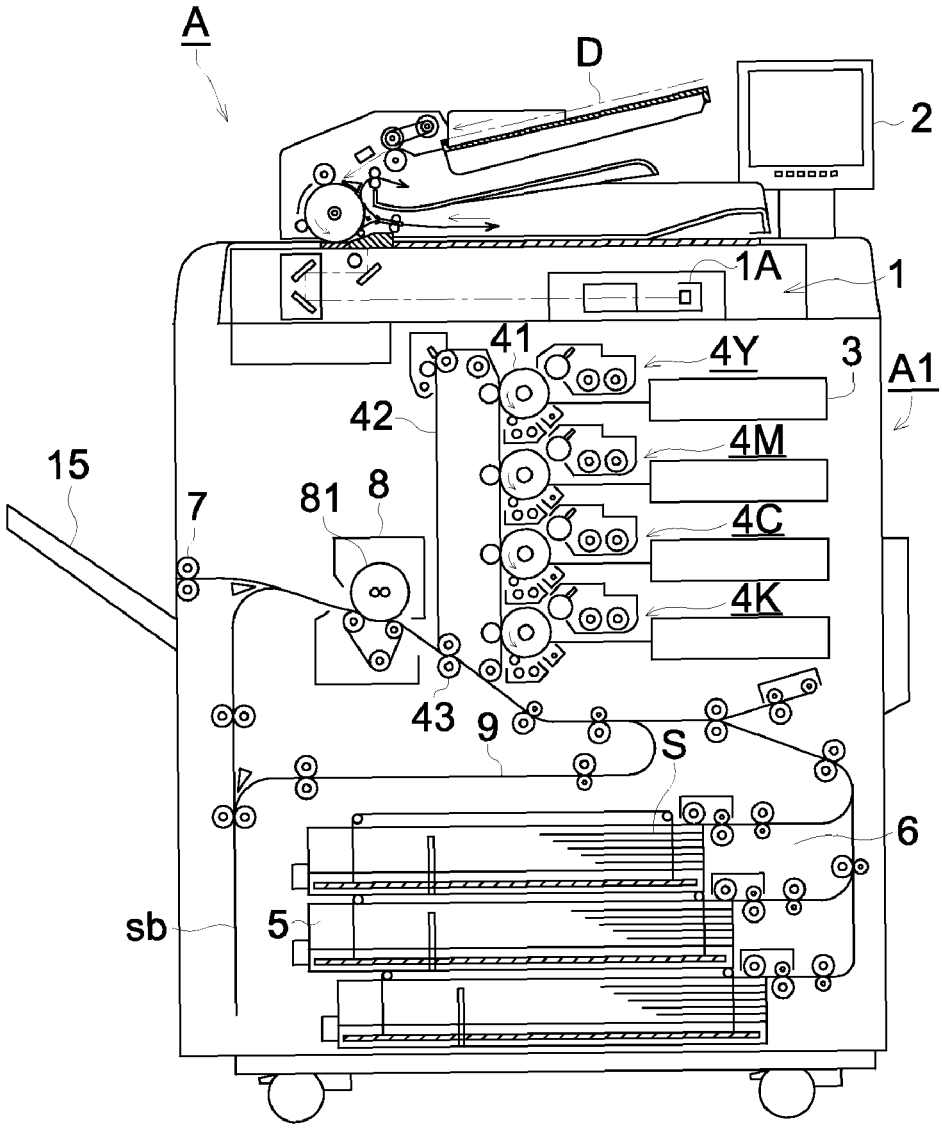
FIG. 1 is a cross sectional view at the central portion of an image forming apparatus of the present invention

FIG. 1 is a cross sectional view at the center of the image forming apparatus relating to this embodiment. The image forming apparatus A is referred to as a tandem type color image forming apparatus including an image forming section A1, a scanner section 1, an operation display section 2, and an automatic document feeder D.

The image forming section A1 includes a plurality of sets of image generation sections 4Y (yellow), 4M (magenta), 4C (cyan), and 4K (black), an image writing section 3 (reference symbols for M, C, K are omitted), a intermediate transfer belt 42, a sheet feed cassette 5, a sheet feeding section 6, a sheet ejection section 7, a fixing device 8, a duplex copy feed section 9. With respect to the detail of the fixing device 8 will be described later.

The image generation sections 4 (4Y, 4M, 4C, 4K) have a developing device and contain respectively a 2-component developer composed of toner of small-diameter particles of each color of yellow (Y), magenta (M), cyan (C), and black (K) and a carrier.

On the upper part of the image forming apparatus A, the automatic document feeder D is loaded. A document loaded on the document table of the automatic document feeder D is conveyed in the direction of the arrow, and an image on one side or images on both sides of the document are read by the optical system of the scanner section 1 and read into a CCD image sensor 1A.

For an analog signal converted photoelectrically by the CCD image sensor 1A, the memory controller performs the analog process, A-D conversion, shading correction, and image compression and then sends a signal to the image writing section 3.

In the image writing section 3, output light from the semiconductor laser is emitted to photosensitive drums 41 (for M, C, and K, the reference numerals are omitted) of the image generation section 4 and a latent image is formed. In the image generation section 4, the processes of charging, exposure, development, transfer, separation, and cleaning are performed. Toner images of the respective colors formed by the image generation section 4 are sequentially transferred onto the rotating intermediate transfer belt 42 by the primary transfer device and a composite color image is formed.

The toner images on the intermediate transfer belt 42, by the secondary transferring roller 43, are transferred to a sheet S conveyed by the sheet feeding conveyance section 6 from the sheet feed cassette 5. The sheet S carrying the toner images is subjected to heat pressure fixing by the fixing device 8, is ejected outside from the sheet ejection section 7, and is loaded on a sheet ejection tray 15.

The numeral 9 denotes a double side conveying path. When forming images on both sides of the sheet, the sheet S after image formation on its first surface (front surface) and fixing by the fixing device 8 is conveyed to the double side conveying path 9, inverted front to back by the switch back path and is again conveyed to the image generation section 4. After image formation on the second surface (back surface), it is discharged to outside the apparatus by the sheet discharging section 7 and placed on the sheet discharge tray 15.

[Fixing Device]

Figure 2:
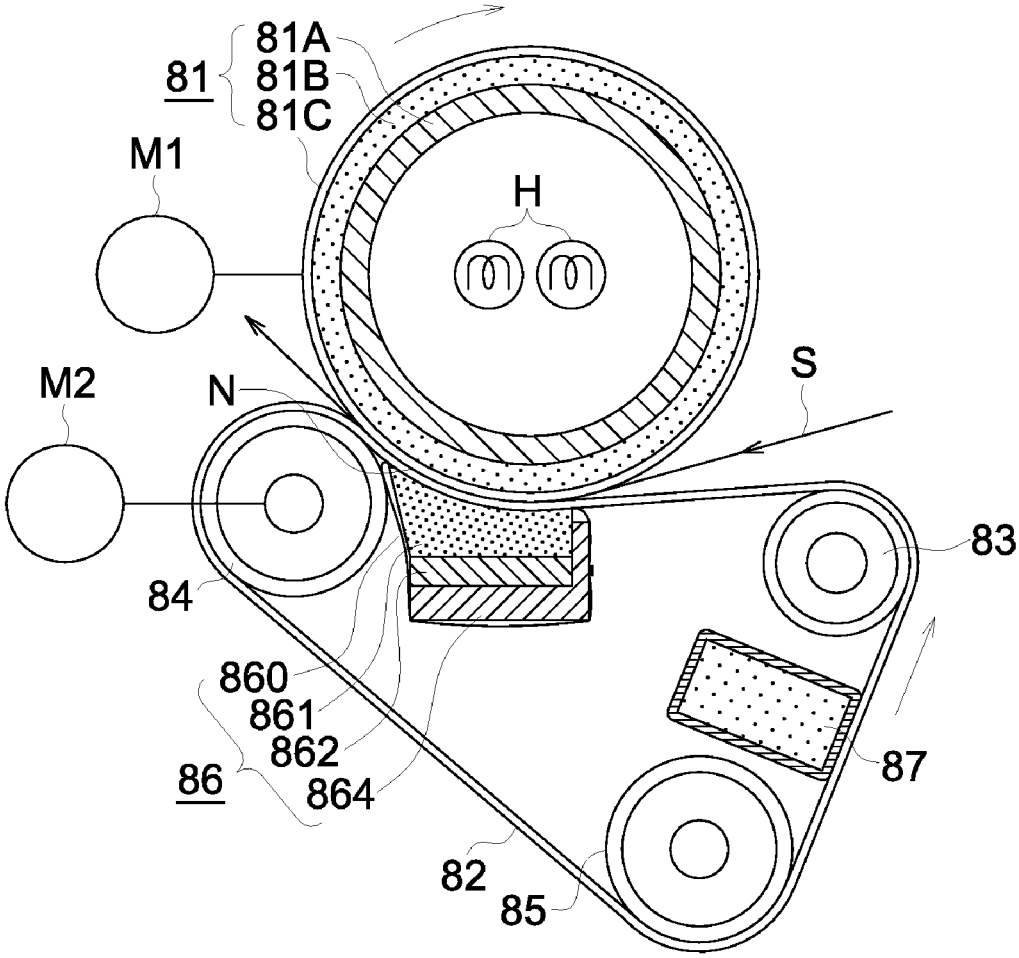
FIG. 2 is a cross sectional view at the central portion of an image forming apparatus 8 of belt nip system.

The following describes the major components of the fixing device 8 of belt nip system of the present embodiment. FIG. 2 is a cross sectional view at the central portion of the fixing device 8 of belt nip system.

In the fixing device 8 of the present invention, heat and pressure are applied to the toner image on sheet S by the fixing nip portion N formed between the heating roller 81 (also called the fixing roller) heated by a halogen heater H, and the fixing belt 82, and the toner image is fixed onto the sheet. In this case, the heating roller 81 and halogen heater H are used as a heating section, and fixing belt 82 and a plurality of rollers for supporting the fixing belt serve as a pressure section. Further, the fixing nip portion is formed by the heating section and pressure section which are pressed against each other.

The heating roller 81 incorporates the halogen heater H serving as a heat source, and is composed of a cylindrical mandrel 81A made of aluminum, iron or the like; an elastic layer 81B made of an heat-resistant HTV silicone rubber to cover the cylindrical mandrel 81A; and a releasing layer 81C made of a fluorine resin such as PFA (perfluoro alkyl vinyl ether) or PTFE (polytetrafluoro-ethylene) to cover the elastic layer 81B.

The fixing belt 82 includes a substrate formed of a heat resistant elastic resin such as polyimide having a thickness of 70 μm; an elastic layer such as a silicone rubber layer having a thickness of 200 μm to cover the outer surface of the substrate; and a releasing layer made of PFA or PTFE having a thickness of 30 μm to cover the elastic layer. The fixing belt 82 is designed to have an endless configuration.

The fixing belt 82 is applied to the outer peripheries of the roller 83 located close to the introductory part of sheet S, the pressure roller 84 on the outlet side of the sheet S and the supporting roller 85, and is brought in contact with the outer peripheral surface of the heating roller 81. The pressure roller 84 is located in the vicinity of the pressure section 86 on the downstream side in the direction of sheet feed (in the direction of rotation). The fixing belt 82 is pressed against the heating roller 81 by the pressure roller 84 together with the pressure section 86, whereby a fixing nip portion N is formed. The pressure roller 84 is arranged on the downstream side of the fixing nip portion N in the direction of sheet feed.

The roller 85 is also called the steering roller. The axis of the roller 85 is tilted by rocking one end of the axis, whereby the roller 85 serves as a skew regulating member to correct the skew of the fixing belt.

[Pressure Section]

The pressure section 86 pressing the fixing belt 82 from inside is arranged in the vicinity of the upstream side of the pressure roller 84 out of the rollers 83, 84 and 85 to which the fixing belt 82 is applied. The fixing belt 82 is pressed against the heating roller 81 by the pressure section 86 together with the pressure roller 84, whereby the fixing nip portion N is formed. The pressure section 86 includes the pressure pad 861 serving as a pressure member, the holding member 862 for holding a pressure pad 861, the holder 864 for securing the holding member 862 wherein both end parts of the holder 864 are supported by a supporting member (not illustrated), and the sliding sheet 860 which covers the pressure pad 861 and slides on the inner circumferential surface of the fixing belt 82.

The pressure pad 861 is made of heat resistant rubber as exemplified by a silicone rubber having a hardness of JISA 10° through 30°. It is in a shape conforming to the curved surface of the heating roller 81 and formed on the holding member 862. The holding member 862 is made of stainless steel, for example. The sliding sheet is made of a heat resistant resin such as polyimide having a thickness of 70 μm, for example, and is formed by emboss molding so that 0.2 mm-high protrusions are arranged at an interval of 0.5 through 1 mm to form irregularities. Formation of irregularities reduces the area in contact with the fixing belt 82 so that friction is reduced. Use of the polyimide increases the strength and enhances resistance to breakage. The holder 864 is made of stainless steel The sliding sheet 860 covers the pressure pad 861 and is secured onto the holder 864. It can be formed in a tube-shaped form and can be secured on the upstream side alone. Alternatively, it can be formed in a non-tube-shaped form and can be secured on the upstream and downstream sides. The holder 864 is pressed by a compression spring through a supporting member.

[Lubricant Supply Member]

The lubricant supply member 87 is arranged on the upstream side of the pressure section 86 in the direction of conveying the fixing belt 82, and on the side of the inner circumferential surface of the fixing belt 82.

The lubricant supply member 87 is formed of a felt such as an aramid fiber. A lubricant reservoir is formed by filling the felt into the bag-shaped PTFE porous film. The lubricant supply member 87 is impregnated with lubricant in advance. The lubricant reservoir stores the lubricant and supplies it through the PTFE porous film on the outer peripheral surface. Silicone oil such as dimethyl silicone oil with a viscosity of 100 through 1000 cs or methylphenyl silicone oil with a viscosity of 100 through 1000 cs is used as the lubricant.

In the fixing device 8 constructed in the aforementioned manner, the heating roller 81 heated by the halogen heater H and driven by the motor M1 rotates in the clockwise direction as illustrated. The pressure roller 84 at the outlet is driven by the motor M2, and rotates the fixing belt 82. The rollers 83 and 85 are driven by rotation of the fixing belt 82. The pressure pad 861 is pressed by the compression spring through the holder 864 and holding member 862. The pressure pad 861 presses the fixing belt 82 against the heating roller 81. The pressure roller 84 presses the fixing belt 82 against the heating roller 81 by the compression spring through the supporting member that support the end part of the pressure roller 84.

Thus, a wide fixing nip portion N is formed between the pressure section 80 (fixing belt unit) and heating roller 81. The fixing belt 82 rotates in the counterclockwise direction as illustrated, by the drive and rotation of the heating roller 81 and pressure roller 84. The unfixed toner on the sheet S having been conveyed is heated and pressed by the fixing nip portion N and is fixed on the sheet S.

Figure 3:
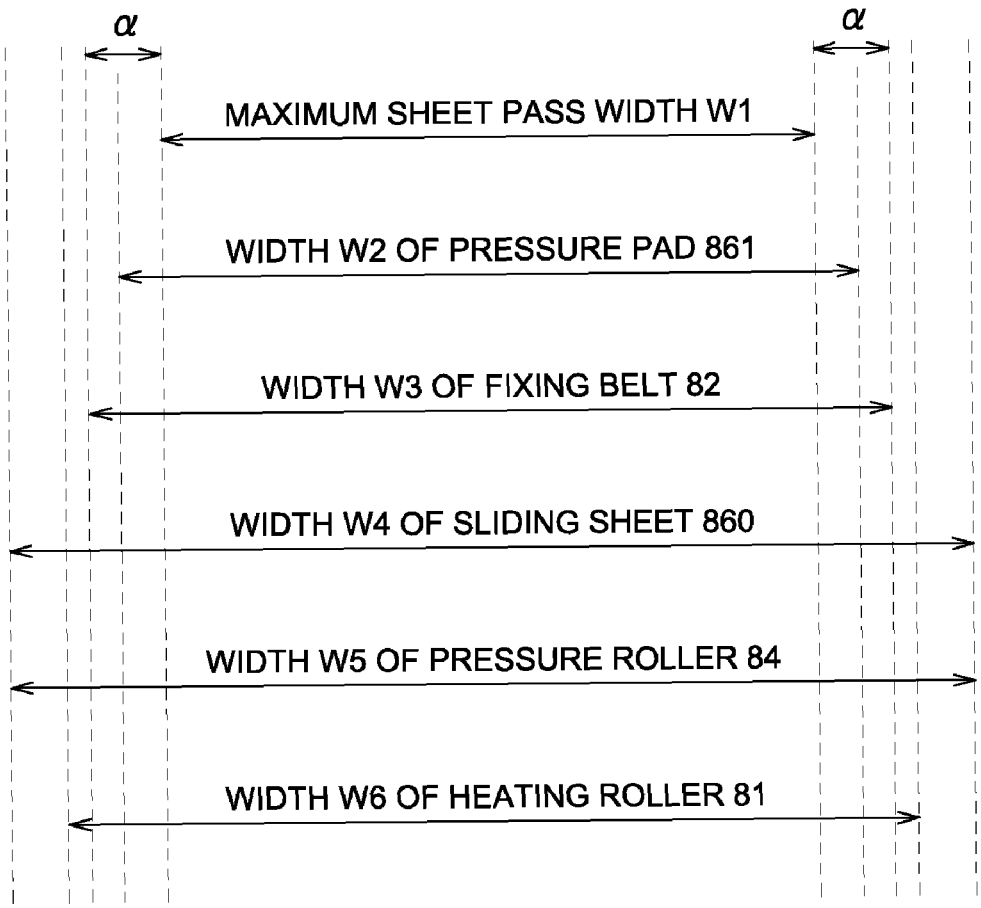
FIG. 3 is a diagram showing the positional relationship of each member of the fixing device 8 in the direction perpendicular to the sheet direction.

Referring to FIG. 3, the following describes the positional relationship of the members of the fixing device 8 in the direction perpendicular to the direction of sheet feed (hereinafter referred to as "axial direction"). In FIG. 3, setting is so made that the following relationship can be expressed, wherein W1 is the maximum sheet pass width of sheet S, W2 is the width of the pressure pad 861, W3 is the width of the fixing belt 82, W4 is the width of the sliding sheet 860, W5 is the width of the pressure roller 84, and W6 is the width of the heating roller 81:

$$W4>W3>W2>W1,$$

$$W5>W3,$$

$$W6>W3$$

The width W4 of the sliding sheet 860 is set at a value greater than the width W3 of the fixing belt 82. This is intended to ensure that the lubricant coated on the inner circumferential surface of the fixing belt will not enter the sliding sheet 860 from the end part of the sliding sheet 860 to stick to the pressure pad 861. If lubricant sticks to the pressure pad 861, the pressure pad 861 will be deformed by oil swelling, and a predetermined level of pressure will be changed, with the result that wrinkles will occur to the sheet during conveyance, or other problems will occur.

Further, even when a sheet having a maximum sheet pass width W1 is passed through the fixing nip portion N, the fixing belt 82 is provided with the grip width α on both end sides by keeping in touch with the heating roller 81 and pressure roller 84. Thus, the following relationship holds.

$$W6, W5, W3>W1+2\times\alpha$$

For example, when W1 is 330 mm, α is set to 15 mm.

Embodiment 1

Regulating Member

Figure 4:
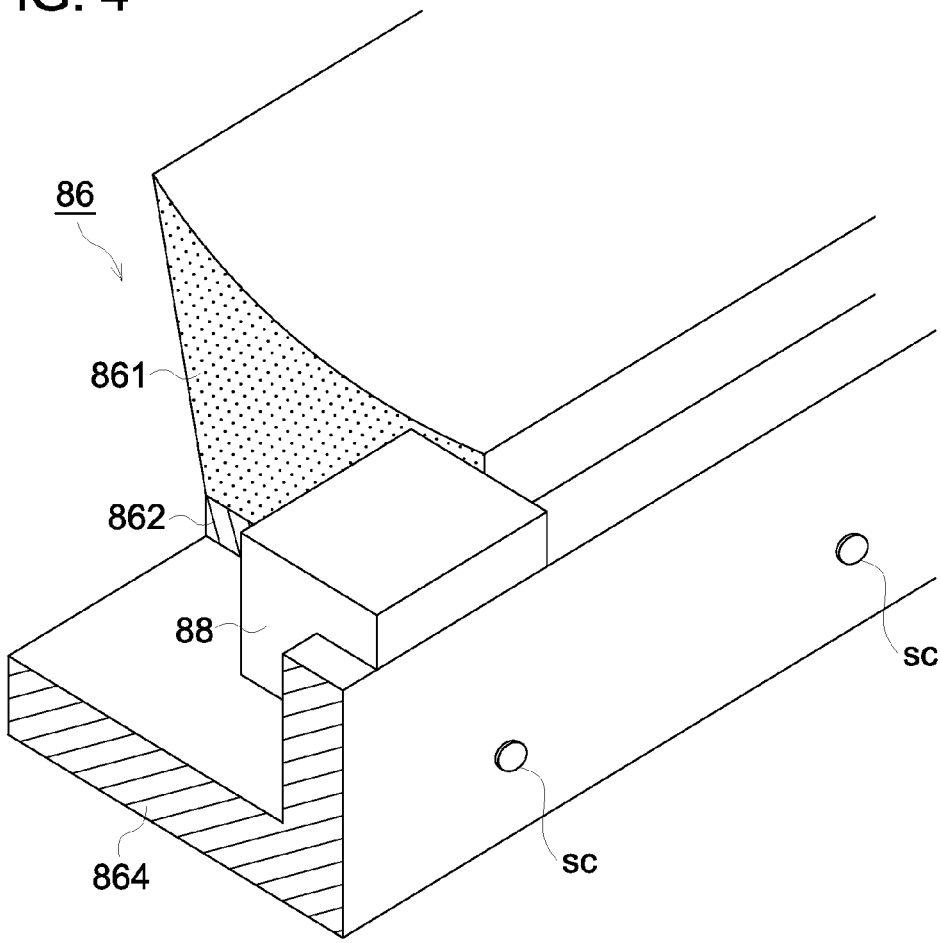
FIG. 4 is a perspective view of the pressure section 86.
Figure 5:
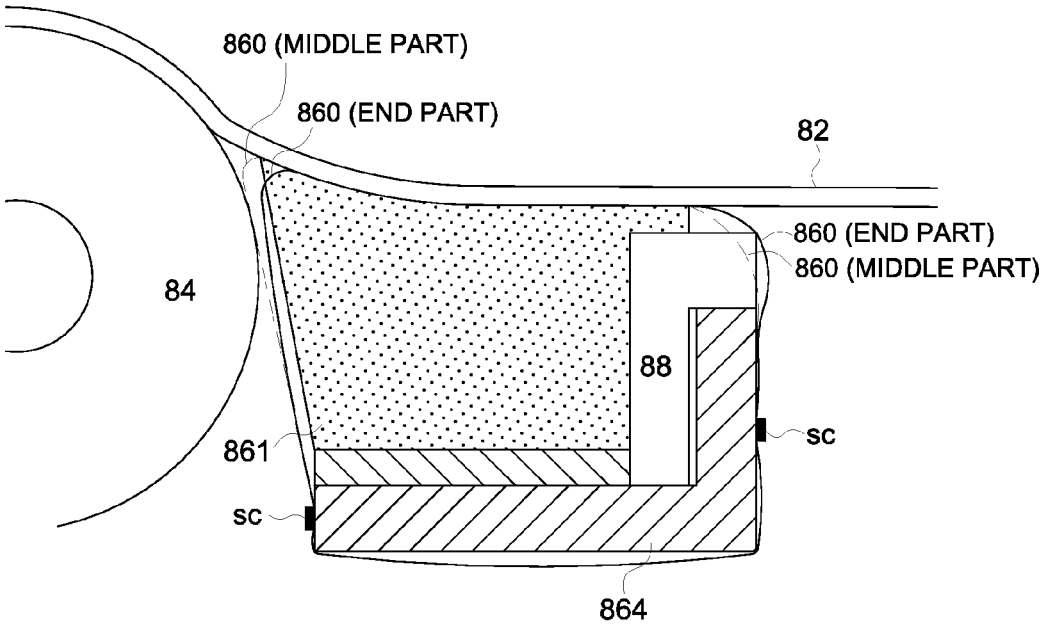
FIG. 5 is a cross sectional view of the pressure section 86.

Referring to FIGS. 4 and 5, the following describes the regulating member installed on the pressure section 86. FIG. 4 is a perspective view of the pressure section 86, and FIG. 5 is a cross sectional view of the pressure section 86. FIG. 4 shows one end part (on the front side of FIG. 2) of the pressure section 86. The same shape is assumed on the other end part on the opposite side. In FIG. 4, the sliding sheet 860 is not illustrated.

The reference numeral 88 is a regulating member. The regulating member 88 is made of an aluminum metal or rigid body of heat resistant resin. The regulating member 88 is arranged outside the pressure pad 861 (pressure member) in the axial direction, and on the upstream side of the fixing nip portion N in the direction of sheet feed. The slack of the sliding sheet 860 is regulated by the regulating member 88. The height of the regulating member 88 is lower than the top surface of the pressure pad 861 to ensure that the regulating member 88 will not come in contact with the fixing belt 82, even when the pressure pad 861 is subjected to elastic transformation and the fixing belt 82 is lowered.

Referring to FIG. 5, the following describes the state of the sliding sheet 860. As shown in FIG. 5, the sliding sheet 860 is sandwiched between the pressure pad 861 and fixing belt 82 on the middle part in the axial direction. Thus, no slack occurs even if a regulating member is not provided (middle part 860). In the meantime, on both ends in the axial direction, the sliding sheet 860 is not positioned by the pressure pad 861. Accordingly, a regulating member 88 is arranged, and tension is applied to the upstream side of the sliding sheet 860 by the regulating member 88. Downstream force (conveyance) is applied to the sliding sheet 860 by the sliding resistance caused by slight contact between the inner circumferential surface of the rotating fixing belt 82 and the sliding sheet 860. However, the regulating member 88 ensures that the end part of the sliding sheet 860 is not misaligned downstream against the sliding resistance.

The present embodiment has been described using an example wherein the regulating member 88 is made of a rigid body. Without the present invention being restricted thereto, the regulating member 88 can be made of an elastic body such as rubber.

As described above, on the end parts of the sliding sheet 860, the regulating members 88 for regulating the slack of the sliding sheet 860 are provided outside the pressure pad 861. This arrangement provides the fixing device capable of solving the problem that the sliding sheet 860 is broken by being pulled inside the nearby pressure roller 84.

Embodiment 2

Figure 6:
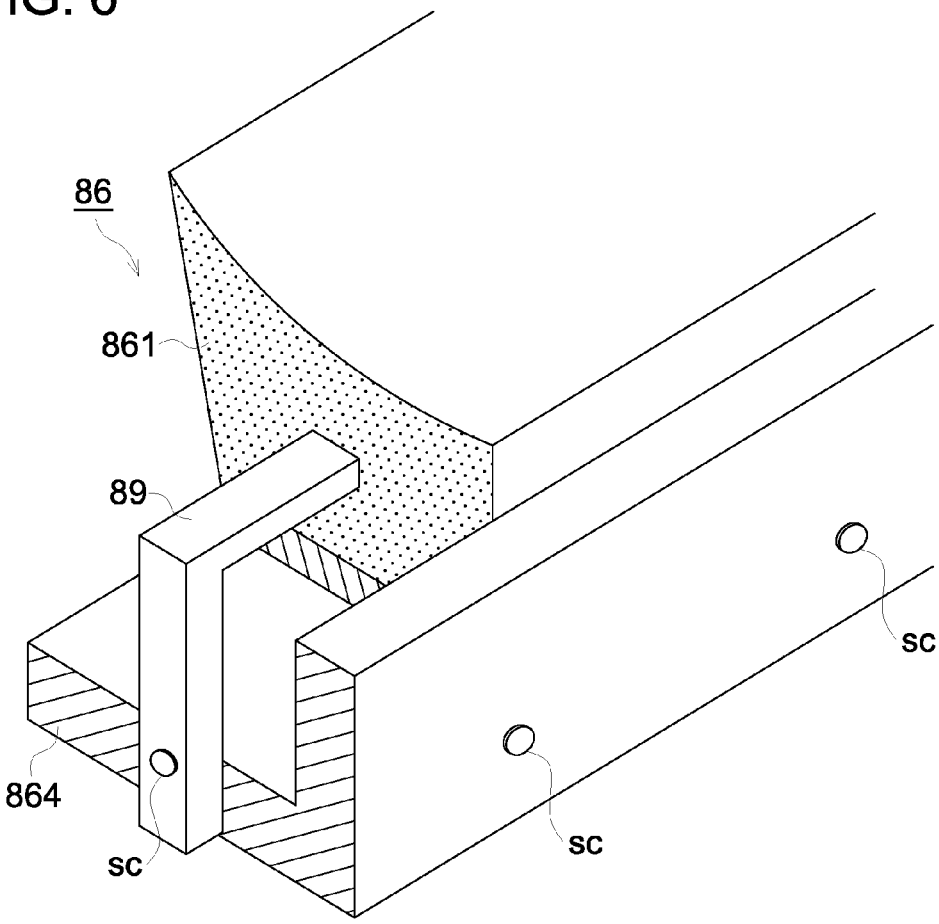
FIG. 6 is a perspective view of the pressure section 86 of the second embodiment of the present invention.
Figure 7:
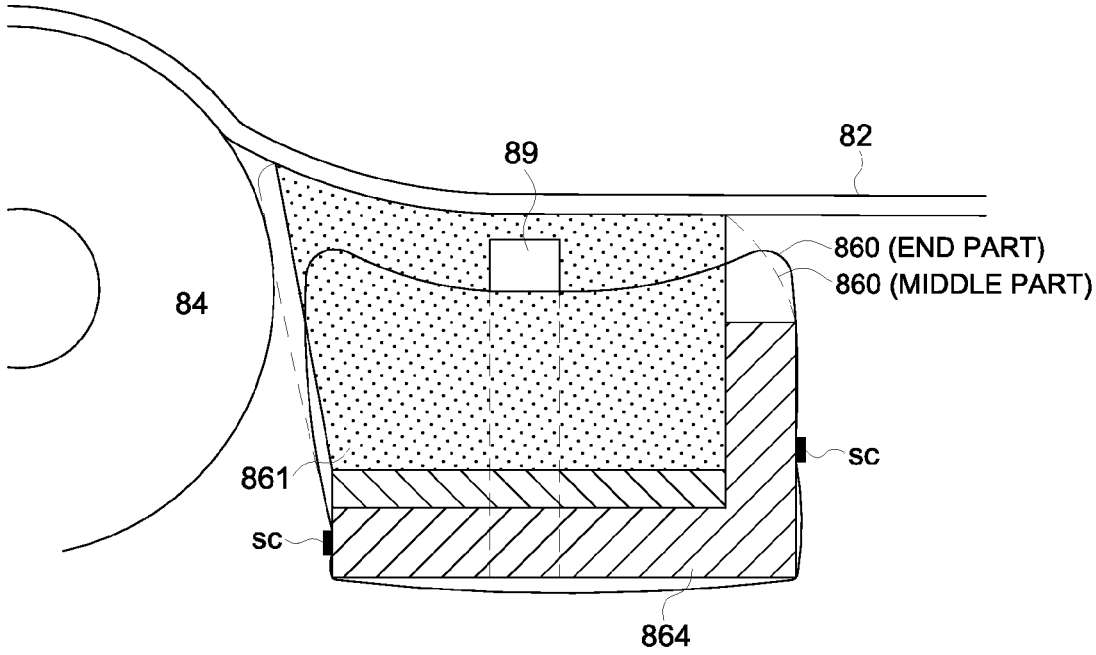
FIG. 7 is a cross sectional view of the pressure section 86 of the second embodiment of the present invention FIG. 8(*a*) is a perspective view of the sliding sheet 860 of the third embodiment, and FIG. 8(*b*) is a top view of the sliding sheet 860.

Referring to FIGS. 6 and 7, the following describes the fixing device 8 of the second embodiment. FIG. 6 is a perspective view of the pressure section 86 of the second embodiment of the present invention. FIG. 7 is a cross sectional view of the pressure section 86 of the second embodiment of the present invention. The description of FIGS. 1 through 3 also applies, except for the structure illustrated in FIGS. 6 and 7. The components having the same functions as those in FIGS. 1 through 5 will be assigned with the same reference numerals and will not be described to avoid duplication.

In this drawing, the (second) regulating member 89 ensures that the end parts of the sliding sheet 860 outside the pressure pad 861 in the axial direction are separated from the inner circumferential surface of the fixing belt 82. As illustrated, the regulating member 89 is arranged a predetermined distance outside the pressure pad 861 in the axial direction. As shown in FIG. 7, the regulating members 89 arranged on both end parts is arranged between the sliding sheet 860 and fixing belt 82, and the sliding sheet 860 is kept separated from the fixing belt 82 on the end parts. This arrangement eliminates any contact between the end parts of the rotating fixing belt 82 and sliding sheet 82. This eliminates the downstream force caused by the sliding resistance resulting from contact between the fixing belt 82 and inner circumferential surface. To be more specific, this arrangement provides a fixing device capable of eliminating the possibility of downstream misalignment of the end parts of the sliding sheet 860 and, hence, solving the problem of the sliding sheet 860 being broken by being pulled inside the nearby pressure roller 84.

Embodiment 3

Figure 8:
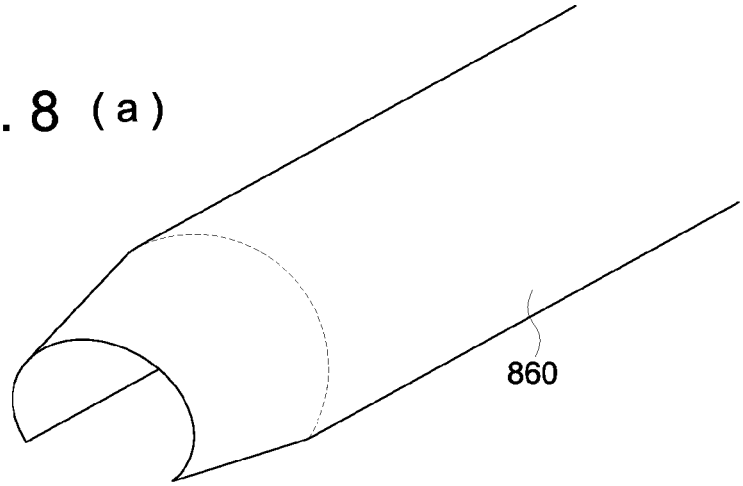
Figure 8:
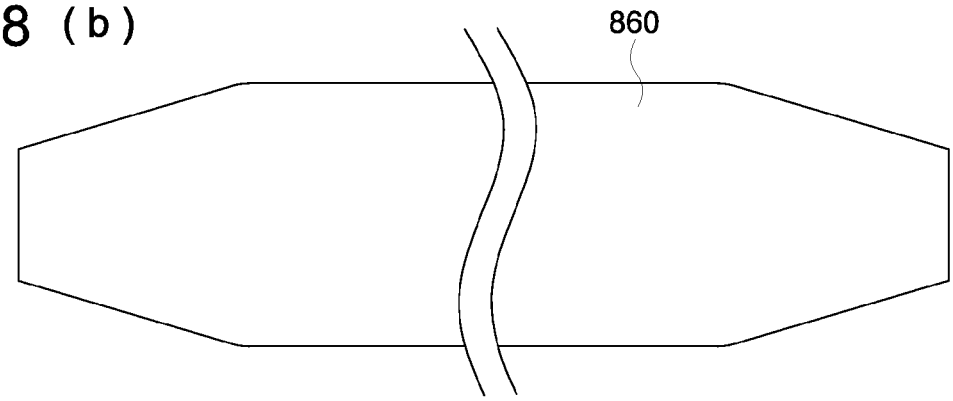

Referring to FIGS. 8(*a*) and 8(*b*), the following describes the fixing device 8 of the third embodiment. FIGS. 8(*a*) and 8(*b*) are diaphragms representing the sliding sheet 860 of the third embodiment, wherein FIG. 8(*a*) is a perspective view of the sliding sheet 860 of the third embodiment, and FIG. 8(*b*) is a top view of the sliding sheet 860. In the illustrated example, the end parts of the sliding sheet 860 are separated from the inner circumferential surface of the fixing belt 82, without using a regulating member.

As shown in this drawing, in the sliding sheet 860, the circumferential length on both end parts is smaller than that at the center. This arrangement provides the following advantages on the end parts of the sliding sheet 860: (1) Reduced slack without misalignment in the downstream direction, and (2) no force applied in the downstream direction resulting from contact with the inner circumferential surface, because of separation from the inner circumferential surface of the fixing belt 82; hence no misalignment in the downstream direction.

Figure 9:
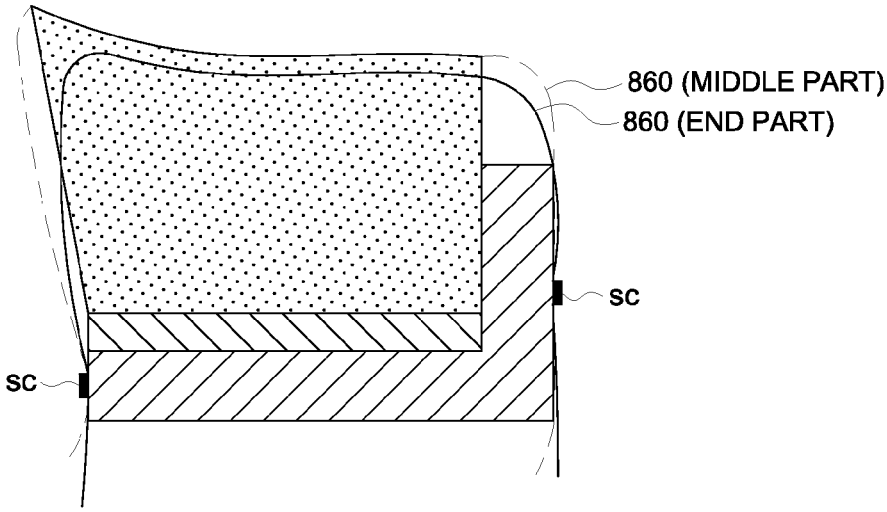
FIG. 9 is a diagram showing that the rectangular sliding sheet 860 is held by the holder 864.

FIG. 9 is a diagram showing that the rectangular sliding sheet 860 is held by the holder 864.

In FIGS. 8(*a*) and 8(*b*), the width of the end parts of the tubeshaped sliding sheet 860 is reduced, and the end parts are separated from the inner circumferential surface of the fixing belt. Without the present invention being restricted thereto, as shown in FIG. 9, it is possible to secured in such a way that slack will not occur on the end parts (Reference numeral 860 (end part)) as compared to the sliding sheet 860 at the center (reference numeral 860 (middle part)), when the sliding sheet is secured on the holder 864 by means of a screw SC.

As described above, by adopting the sliding sheet wherein the end parts outside the pressure pad 861 are separated from the inner circumferential surface of the fixing belt 82, it is possible to provide a fixing device capable of solving the problem wherein the sheet is pulled inside the nearby pressure roller 84, whereby the sliding sheet 860 is broken.

Embodiment 4

Figure 10:
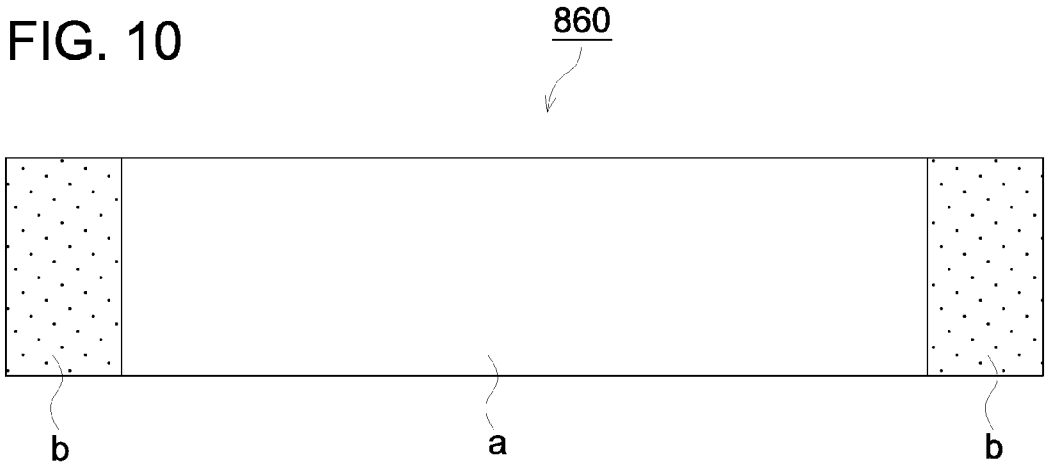
FIG. 10 is a diaphragm showing the sliding sheet 860 of another embodiment.

FIG. 10 is a diaphragm showing the sliding sheet 860 of the fourth embodiment. It shows the side of the belt sliding surface. In the sliding sheet 860 illustrated in this drawing, only the end faces outside the covering area for the pressure pad 861 are coated with fluorine resin. The reference numeral "a" of the drawing shows the area covering the pressure pad 861. The reference numeral "b" denotes the end faces outside it. Only the areas indicated by the reference numeral "b" are coated with fluorine.

The area indicated by the reference numeral "b" is coated with fluorine. This arrangement reduces the sliding resistance with the inner circumferential surface of the fixing belt 82 in this position. This reduces the downstream force resulting from slight contact with the inner circumferential surface of the fixing belt 82 so that downstream misalignment hardly occurs. Only the end parts are coated with fluorine resin without the middle part coated therewith. This is because there is heavy sliding force applied between the middle part pressed by the pressure pad 861 and the inner circumferential surface of the fixing belt 82, and this will easily cause removal of the coated fluorine resin.

Other Embodiments of Fixing Device

Figure 11:
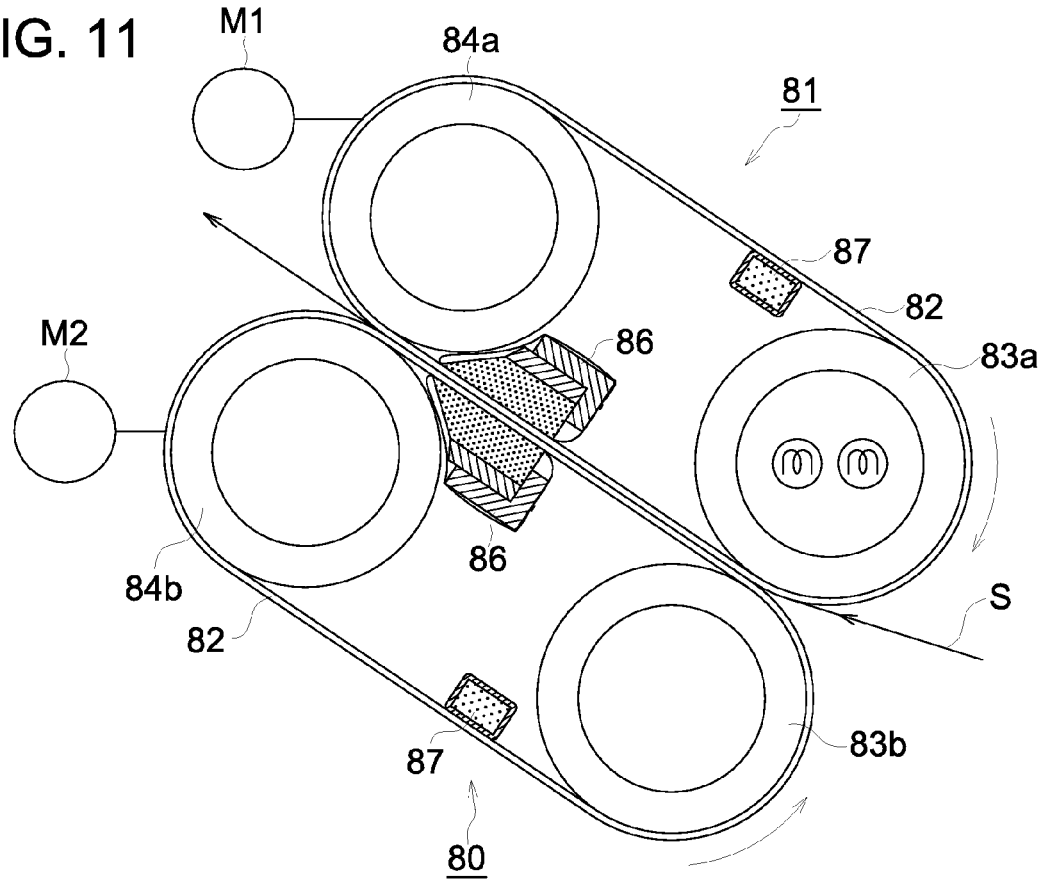
FIG. 11 is a diaphragm showing an example of the fixing device wherein each of the pressure section 80 and the heating section 81 provided with a heat source is equipped with a fixing belt 82.
Figure 12:
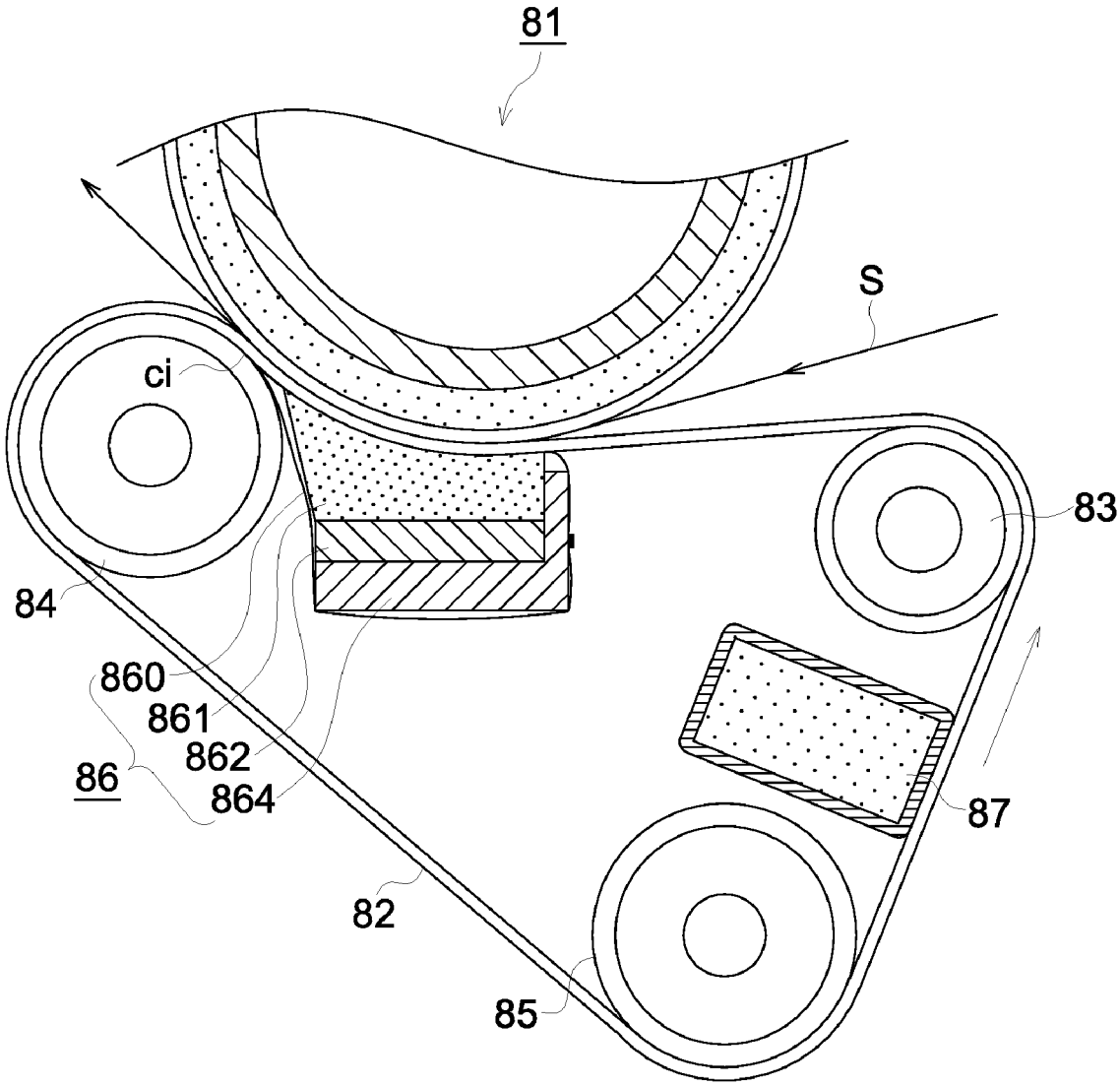
FIG. 12 is a diaphragm showing that the sliding sheet is pulled into the pressure roller.

With reference to FIGS. 1 through 10, description has been made of the fixing device provided with a fixing belt 82 only on the side of the pressure section on the lower side. Without the present invention being restricted thereto, the fixing device can be equipped with a fixing belt and pressure member on the inner circumferential surface of the fixing belt, on the heating section or on both the heating section and pressure section. FIG. 11 is a diaphragm showing an example of the fixing device wherein each of the pressure section 80 and the heating section 81 provided with a heat source is equipped with a fixing belt 82. In the fixing device shown in this diagram, both the fixing belts are provided with a sliding sheet 860, pressure pad 861, regulating member 88, and lubricant supply member 87. In this diagram, the components having the same functions as those of FIGS. 1 through 10 are assigned with the same reference numerals, and will not be described to avoid duplication.

As described in the drawing, the arrangement of regulating members 88 installed on both the fixing belts provides a fixing device capable of solving the problem wherein the sliding sheet 860 is pulled inside the nearby rollers 84*a* and 84*b* and is broken.

EXAMPLE

The following describes the Example of the present invention. The fixing device and image forming apparatus shown in FIGS. 1 through 10 were used in the Example.

[Test Conditions]

The A4-sized sheet at a speed of 80 sheets per minute was printed on a continual basis using the fixing device of Examples 1 through 3 shown below The number of prints was checked and evaluation was made to see if the end part of the sliding sheet 860 was broken or not.

Example 1

Fixing device of the first embodiment (FIGS. 4, 5 and others)

Example 2

Fixing device of the third embodiment (FIGS. 8(*a*) and 8(*b*) and others)

Example 3

Fixing device of the fourth embodiment (FIG. 10 and others)

[Test Result]

TABLE 1

| Number of prints (kp) | Comparative example | Example 1 | Example 2 | Example 3 |
|---|---|---|---|---|
| 100 | A | A | A | A |
| 150 | A | A | A | A |
| 200 | B | A | A | A |
| 250 | | A | A | B |
| 300 | | A | A | |

Method and Level of Evaluation:

Evaluation was made to see if the end part of the sliding sheet 860 was broken or not.

A: Sheet not broken

B: Sheet broken

In Example 3, there was an increase in the number of prints before the sheet was broken, as compared to the Comparative Example, and an effect for a prolonged service life was observed. In Examples 1 and 2, breakage of the sliding sheet 860 did not occur within the range of the replacement cycle of the fixing device 8 up to 300 kp.

The present invention provides a fixing device using a fixing belt that prevents problems wherein the sliding sheet covering the pressure member that presses the inner circumferential surface of the fixing belt is pulled into the nearby rollers, and that eliminates the possibility of the sliding sheet being broken.

What is claimed is:

1. A fixing device including a heating section and a pressure section which presses the heating section to form a fixing nip portion comprising:

an endless fixing belt being rotated;

a plurality of rollers which stretch the fixing belt therebetween;

a pressure member which presses the fixing belt toward the fixing nip portion from a side of an inner circumferential surface of the fixing belt, being provided in a vicinity of a roller being arranged on a downstream side of the fixing nip portion in a rotating direction of the fixing belt;

a sliding sheet which covers the pressure member; and a regulating member arranged outside the pressure member in a direction perpendicular to a direction of sheet feed and on an upstream side of the fixing nip portion in the direction of sheet feed for regulating a slack of the sliding sheet.

2. The fixing device of claim 1, wherein the regulating member is located on an upstream side of the pressure member in a direction of a sheet feed at a position where the regulating member does not contact the fixing belt.

3. An image forming apparatus comprising:

an image forming section for forming a toner image on a sheet; and the fixing device of claim 1 which heats, presses and fixes the toner image formed by the image forming section onto the sheet in the fixing nip portion.

4. A fixing device including a heating section and a pressure section which presses the heating section to form a fixing nip portion comprising:

an endless fixing belt being rotated;

a plurality of rollers which stretch the fixing belt therebetween;

a pressure member which presses the fixing belt toward the fixing nip portion from a side of an inner circumferential surface of the fixing belt, being provided in a vicinity of a roller being arranged on a downstream side of the fixing nip portion in a rotating direction of the fixing belt; and a sliding sheet which covers the pressure member, wherein a whole part of the sliding sheet outside a pressing surface of the pressure member in a direction perpendicular to the direction of sheet feed is arranged to be separated from a straight line extended from the inner circumferential surface of the fixing belt toward the pressure member.

5. The fixing device of claim 4, further comprising, a regulating member being located outside the pressure member in the direction perpendicular to the direction of sheet feed to separate the end part of the sliding sheet from the inner circumferential surface of the fixing belt.

6. The fixing device of claim 5, wherein the regulating member is located between the end part of the sliding sheet and the fixing belt.

7. An image forming apparatus comprising:

an image forming section for forming a toner image on a sheet; and the fixing device of claim 4 which heats, presses and fixes the toner image formed by the image forming section onto the sheet in the fixing nip portion.

8. The fixing device of claim 4, wherein a part of the sliding sheet, which is located between both ends of the fixing belt and outside a pressing surface of the pressure member in the direction perpendicular to the direction of sheet feed is arranged to be separated from the inner circumferential surface of the fixing belt.

9. A fixing device including a heating section and a pressure section which presses the heating section to form a fixing nip portion comprising:

an endless fixing belt being rotated;

a plurality of rollers which stretch the fixing belt therebetween;

a pressure member which presses the fixing belt toward the fixing nip portion from a side of an inner circumferential surface of the fixing belt, being provided in a vicinity of a roller being arranged on a downstream side of the fixing nip portion in a rotating direction of the fixing belt; and a sliding sheet which covers the pressure member, wherein only an end face of the sliding sheet outside a covering area for the pressure member is coated with fluorine resin.

10. An image forming apparatus comprising:

an image forming section for forming a toner image on a sheet; and the fixing device of claim 9 which heats, presses and fixes the toner image formed by the image forming section onto the sheet in the fixing nip portion.

11. A fixing device including a heating section and a pressure section which presses the heating section to form a fixing nip portion comprising:

an endless fixing belt being rotated;

a plurality of rollers which stretch the fixing belt therebetween;

a pressure member which presses the fixing belt toward the fixing nip portion from a side of an inner circumferential surface of the fixing belt, being provided in a vicinity of a roller being arranged on a downstream side of the fixing nip portion in a rotating direction of the fixing belt;

a sliding sheet which covers the pressure member; and a regulating member being located outside the pressure member in the direction perpendicular to the direction of sheet feed to separate the end part of the sliding sheet from the inner circumferential surface of the fixing belt, wherein an end part of the sliding sheet outside the pressure member is arranged to be separated from the inner circumferential surface of the fixing belt.

* * * * *